US007966919B2

(12) United States Patent
Kolodkin et al.

(10) Patent No.: US 7,966,919 B2
(45) Date of Patent: Jun. 28, 2011

(54) SAFE INSPECTION SYSTEM AND KIT

(75) Inventors: Arkadi Kolodkin, Tel Aviv (IL); Danny Kovetz, Nirit (IL)

(73) Assignee: K.P.S.—Karil Protective Systems Ltd., Herzliya (IL)

( * ) Notice: Subject to any disclaimer, the term of this patent is extended or adjusted under 35 U.S.C. 154(b) by 311 days.

(21) Appl. No.: 11/917,059

(22) PCT Filed: Jan. 4, 2007

(86) PCT No.: PCT/IL2006/000750

§ 371 (c)(1),
(2), (4) Date: Dec. 10, 2007

(87) PCT Pub. No.: WO2007/000767

PCT Pub. Date: Jan. 4, 2007

(65) Prior Publication Data

US 2008/0196577 A1 Aug. 21, 2008

Related U.S. Application Data

(60) Provisional application No. 60/694,245, filed on Jun. 28, 2005.

(51) Int. Cl.
*F42B 33/06* (2006.01)

(52) U.S. Cl. ..... 86/50

(58) Field of Classification Search ..... 86/50; 429/17, 429/286; 109/2, 6, 7

See application file for complete search history.

(56) References Cited

U.S. PATENT DOCUMENTS 2,345,478 A * 3/1944 Hundley ..... 109/2
3,667,404 A * 6/1972 Foster ..... 109/8
4,027,601 A 6/1977 Hickerson
4,055,247 A 10/1977 Benedick et al.
4,432,285 A 2/1984 Boyars et al.
4,437,382 A 3/1984 Yerushalmi
4,543,872 A 10/1985 Graham et al.

(Continued)

FOREIGN PATENT DOCUMENTS

EP 0299902 A2 1/1989

(Continued)

OTHER PUBLICATIONS

Supplemental European Search Report of European Patent Application EP 06745187.

*Primary Examiner* — Stephen M Johnson

(74) *Attorney, Agent, or Firm* — Natoro, Michalos & Zaccaria P.C.

(57) ABSTRACT

A safe inspection system for the manual inspection of personal luggage, which comprises an inspection module including at least one inspection member which defines an inspection surface, for supporting a potentially explosive object for manual inspection by an inspector; a blast containment container arranged in a position of immediate communication with the inspection module; and transfer means for effecting the immediate transfer of a suspicious inspected object from the inspection surface to the blast containment container by an inspector without requiring further handling of the object by the inspector, thereby to immediately confine the object within the blast containment container and so as to thus reduce the reduce blast damage in the event that the suspicious object explodes after confinement therewithin. The present invention also includes a kit for converting a blast containment container to a safe inspection system.

24 Claims, 10 Drawing Sheets

U.S. PATENT DOCUMENTS

| | | | | |
|---|---|---|---|---|
| 4,889,258 | A | 12/1989 | Yerushalmi | |
| 5,157,223 | A | 10/1992 | Wheeler et al. | |
| 5,267,665 | A | 12/1993 | Sanai et al. | |
| 5,348,178 | A | 9/1994 | McLain | |
| 5,613,453 | A | 3/1997 | Donovan | |
| 5,645,184 | A | 7/1997 | Rowse et al. | |
| 5,654,053 | A | 8/1997 | Crane et al. | |
| 5,668,342 | A * | 9/1997 | Discher | 86/50 |
| 6,019,237 | A | 2/2000 | Durham | |
| 6,112,931 | A | 9/2000 | Booth et al. | |
| 6,644,165 | B1 | 11/2003 | King | |
| 2003/0058112 | A1 * | 3/2003 | Gleine | 340/573.1 |

FOREIGN PATENT DOCUMENTS

| | | | |
|---|---|---|---|
| FR | 2317124 | A1 | 2/1977 |
| GB | 2387526 | A | 10/2003 |

* cited by examiner

SAFE INSPECTION SYSTEM AND KIT

This application claims priority form Provisional Application No. 60/694,245 as filed on Jun. 28, 2005.

FIELD OF THE INVENTION

The present invention relates generally to personal security, and particularly to systems for the manual inspection of personal luggage, such as may be found at any location which may serve as a target for the illegal introduction of explosive devices thereinto or therethrough.

BACKGROUND OF THE INVENTION

The danger posed by terrorists seeking to transport explosives into or through crowded public places, such as passenger terminals, is well known. There has been a public awareness of this particularly since the terrorist attacks of Sep. 11, 2001.

While many systems have been introduced to effectively screen large pieces of luggage, such as suitcases, prior to loading onto aircraft or other forms of transportation, the inspection of personal affects, such as back packs and handbags, is particularly problematic. This is especially so where an initial manual inspection is performed on a desk or table placed at an entry point into closed public places, such as airport terminals, train stations, theaters, government offices, and many other public and private premises. As is well know, if a terrorist seeks to detonate an explosive device in a crowded place, his intention may be to smuggle the device deep into the premises so as to detonate the device so as to cause maximum casualties. In the event that the device is discovered during a manual inspection of his personal effects by a security guard, there are no satisfactory solutions that can effectively reduce the number of casualties and the damage to the immediate environment, should the bomb detonate after discovery.

The prior art includes many different types of apparatus for attenuating the effect of an explosion in a confined space including the following US patents: U.S. Pat. No. 6,644,165 entitled "Explosion Containment Vessel;" U.S. Pat. No. 6,112,931 entitled "Blast Attenuating Containers;" U.S. Pat. No. 6,019,237 entitled "Modified Container Using Inner Bag;" U.S. Pat. No. 5,654,053 entitled "High-Energy-Absorbing Enclosure For Internal Explosion Containment;" U.S. Pat. No. 5,645,184 entitled "Aircraft Cargo Container;" U.S. Pat. No. 5,613,453 entitled "Method and Apparatus for Containing and Suppressing Explosive Detonations;" U.S. Pat. No. 5,348,178 entitled "Container Systems For High Explosive Test Agents;" U.S. Pat. No. 5,267,665 entitled "Hardened Luggage Container;" U.S. Pat. No. 5,157,223 entitled "Explosive Attenuating Structure;" U.S. Pat. No. 4,889,258 entitled "Blast-Resistant Container;" U.S. Pat. No. 4,543,872 entitled "Blast Attenuator;" U.S. Pat. No. 4,437,382 entitled "Bomb Disposal Device;" U.S. Pat. No. 4,432,285 entitled "Bomb Blast Attenuator;" U.S. Pat. No. 4,055,247 entitled "Explosion Containment Device;" and U.S. Pat. No. 4,027,601 entitled "Container for Explosive Device."

There are also various products known in the marketplace, including the semi-confined and fully confined bomb containment containers manufactured and sold by the Mistral Security Inc., of Bethesda, Md., USA. The semi-confined containers have the appearance of normal waste receptacles that might be found at any type of public facility, such as at airports and railway stations. These containers are constructed however so as to partial confine a blast therewithin, so as to direct it upwards, rather than in a 360° direction. This serves to prevent the vast majority of injuries and destruction of property that might otherwise occur. Fully confined bomb containment containers are constructed to fully confine an explosion occurring therewithin.

Even with such systems however, the person performing the manual inspection may have only seconds to act, such that manually placing a suspicious object in a semi-confined bomb containment container as described, may not be an option.

SUMMARY OF THE INVENTION

The present invention seeks to provide a safe inspection system, constructed so as to permit manual inspection of personal luggage, such as backpacks, handbags, purses and the like, at the entry to places considered to warrant such inspections, while at the same time providing immediate safety from detonation of an explosive device that may be discovered in personal luggage, thereby overcoming disadvantages of the prior art.

A further aim of the present invention is to provide a kit for converting existing blast containment containers into safe inspection systems for the manual inspection of personal luggage, substantially as described herein.

There is thus provided, in accordance with a preferred embodiment of the present invention, a safe inspection system for the manual inspection of personal luggage, which includes:

an inspection module including one or more inspection members which define an inspection surface, for supporting a potentially explosive object for manual inspection by an inspector;

a blast containment container arranged in a position of immediate communication with the inspection module; and transfer apparatus for effecting the immediate transfer of a suspicious inspected object from the inspection surface to the blast containment container by an inspector without requiring further handling of the object by the inspector, thereby to immediately confine the object within the blast containment container and so as to thus reduce the blast damage in the event that the suspicious object explodes after confinement therewithin.

Additionally in accordance with the present embodiment, the blast containment container has an inlet for admitting the suspicious object, and wherein the transfer apparatus is operative to selectably move the one or more inspection members relative to the blast containment container from a closed position wherein the at least one inspection member covers the inlet to an open position wherein the at least one inspection member does not cover the inlet.

Further in accordance with the present embodiment, the one or more movable inspection members and surface are disposed generally above the inlet, and the transfer apparatus also includes resistive apparatus above the inspection surface and the inlet, the resistive apparatus applying a resistive force to the suspicious object so as to maintain it generally over the inlet until the inlet is exposed by the movement of the inspection member, such that the inspection surface no longer supports the suspicious object thereon, thereby to cause the admission of the suspicious object through the inlet of the blast containment container under gravitational acceleration.

Additionally in accordance with the present embodiment, the one or more movable inspection members has a generally horizontal orientation, and the transfer apparatus includes apparatus for moving the one or more movable inspection members in a generally lateral direction, thereby to uncover the inlet of the blast containment container, and the resistive apparatus includes a barrier element arranged over a portion of the inspection surface, operative to cause a relative movement between the object located on the inspection surface and the inspection surface, thereby to maintain the object generally over the inlet until exposure thereof.

Further in accordance with the present embodiment, the barrier element is arranged in a stationary position with respect to the inlet of the blast containment container.

Additionally in accordance with the present embodiment, the system also includes apparatus for movably mounting the inspection module relative to the blast containment container, which includes one of the following group:

pivot apparatus;

sliding apparatus; and track apparatus.

Further in accordance with the present embodiment, the system also includes retrieval apparatus associated with the blast containment container for facilitating further processing of the suspicious object at a safe location, wherein the retrieval apparatus includes a liner located within the containment container for cushioning the fall of the suspicious object into the container; and apparatus for elevating the liner so as to raise the suspicious object therewithin for further processing.

Additionally in accordance with the present embodiment, the retrieval apparatus may also or alternatively include apparatus for moving the system from a first location to a second location, for further processing of the suspicious object within the container.

Further in accordance with the present embodiment, the blast containment container is a semi-confined blast containment container or a fully confined blast containment container.

There is also provided, in accordance with a further preferred embodiment of the present invention, a kit for converting a blast containment container to a safe inspection system for the manual inspection of personal luggage, which includes:

an inspection module including one or more inspection members which define an inspection surface, for supporting a potentially explosive object for manual inspection by an inspector, and arranged in a position of immediate communication with the a blast containment container; and transfer apparatus for effecting the immediate transfer of a suspicious inspected object from the inspection surface to the blast containment container by an inspector without requiring further handling of the object by the inspector, thereby to immediately confine the object within the blast containment container and so as to thus reduce the blast damage in the event that the suspicious object explodes after confinement therewithin.

Additionally in accordance with the present embodiment, the blast containment container has an inlet for admitting the suspicious object, and wherein the transfer apparatus is operative to selectably move the one or more inspection members relative to the blast containment container from a closed position wherein the at least one inspection member covers the inlet to an open position wherein the at least one inspection member does not cover the inlet.

Further in accordance with the present embodiment, the one or more movable inspection members and surface are disposed generally above the inlet, and the transfer apparatus also includes resistive apparatus above the inspection surface and the inlet, the resistive apparatus applying a resistive force to the suspicious object so as to maintain it generally over the inlet until the inlet is exposed by the movement of the inspection member, such that the inspection surface no longer supports the suspicious object thereon, thereby to cause the admission of the suspicious object through the inlet of the blast containment container under gravitational acceleration.

Additionally in accordance with the present embodiment, the one or more movable inspection members has a generally horizontal orientation, and the transfer apparatus includes apparatus for moving the one or more movable inspection members in a generally lateral direction, thereby to uncover the inlet of the blast containment container, and the resistive apparatus includes a barrier element arranged over a portion of the inspection surface, operative to cause a relative movement between the object located on the inspection surface and the inspection surface, thereby to maintain the object generally over the inlet until exposure thereof.

Further in accordance with the present embodiment, the barrier element is arranged in a stationary position with respect to the inlet of the blast containment container.

Additionally in accordance with the present embodiment, the system also includes apparatus for movably mounting the inspection module relative to the blast containment container, which includes one of the following group:

pivot apparatus;

sliding apparatus; and track apparatus.

Further in accordance with the present embodiment, the system also includes retrieval apparatus associated with the blast containment container for facilitating further processing of the suspicious object at a safe location, wherein the retrieval apparatus includes a liner located within the containment container for cushioning the fall of the suspicious object into the container; and apparatus for elevating the liner so as to raise the suspicious object therewithin for further processing.

Additionally in accordance with the present embodiment, the retrieval apparatus may also or alternatively include apparatus for moving the system from a first location to a second location, for further processing of the suspicious object within the container.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
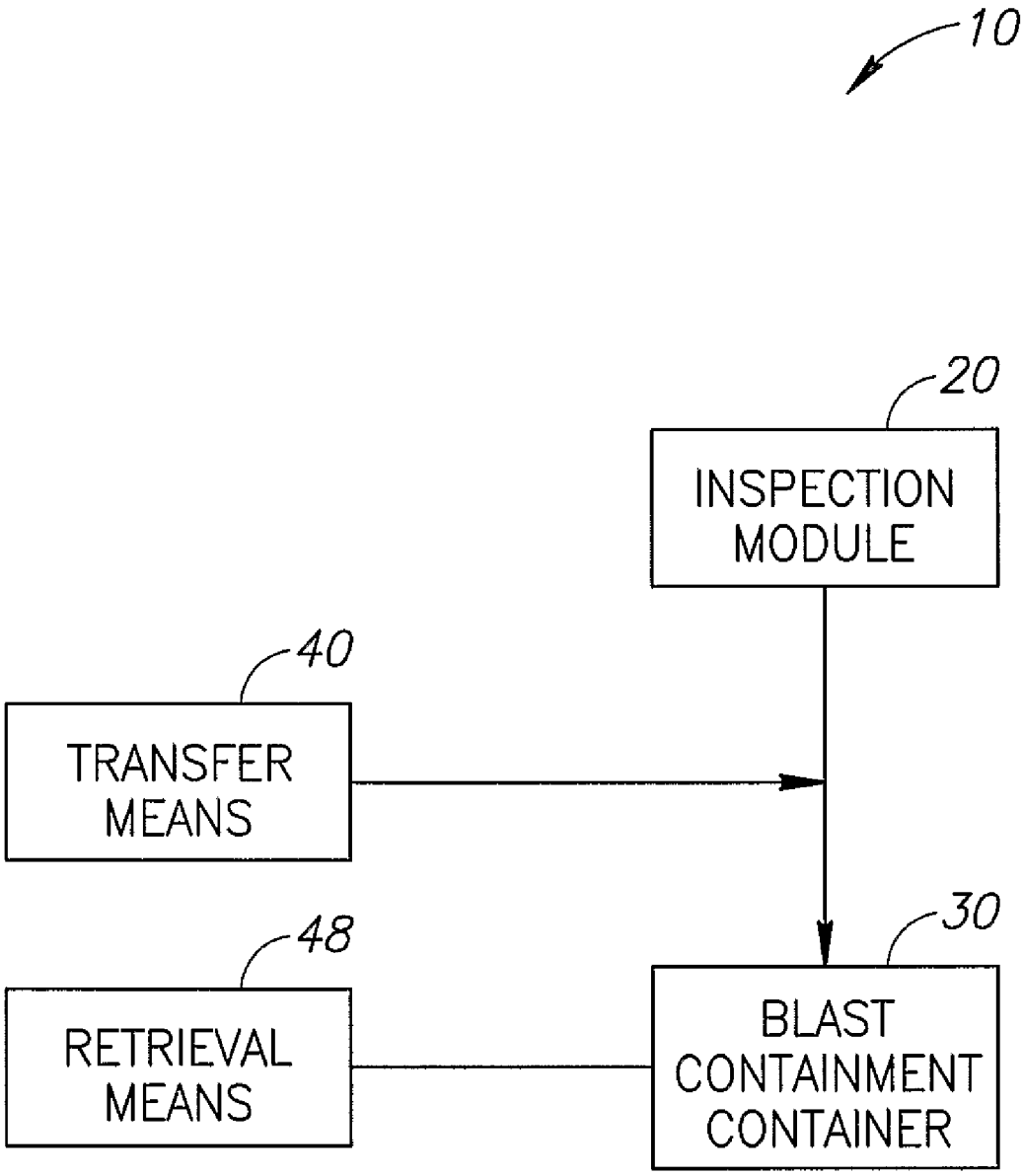
FIG. 1 is a block diagram representation of a safe system for the manual inspection of personal luggage, constructed and operative in accordance with the present invention.

Referring now to FIG. 1, there is provided a safe inspection system for the manual inspection of personal luggage, such as backpacks, handbags, purses and packages, constructed and operative in accordance with the present invention. The present invention does not change the nature of the inspection of personal luggage, per se, but facilitates the immediate disposal of suspicious objects, and considerably reduces the chances of injury to persons located nearby, and damage to property, from the detonation of an explosive device disposed of in accordance with the present invention.

It may thus be seen that the system 10 of the present invention includes, when taken at a most basic level, an inspection module, referenced generally 20, a blast containment container, referenced generally 30, transfer means, referenced generally 40, for transferring a suspicious object from the inspection module 20 to the blast containment container 30, and retrieval means 48, for further processing of the suspicious object at a safe location. Retrieval means 48 preferably includes both means for recovering an object from the blast containment container 30, and means for remotely moving the remainder of system 10 from one location to another. While the retrieval means 48 is described hereinbelow as being typically a manual means, having various cables attached to the system, it may also include semi-automatic or automatic means, or remote controlled means for performing the same functions as described hereinbelow.

Figure 2B:
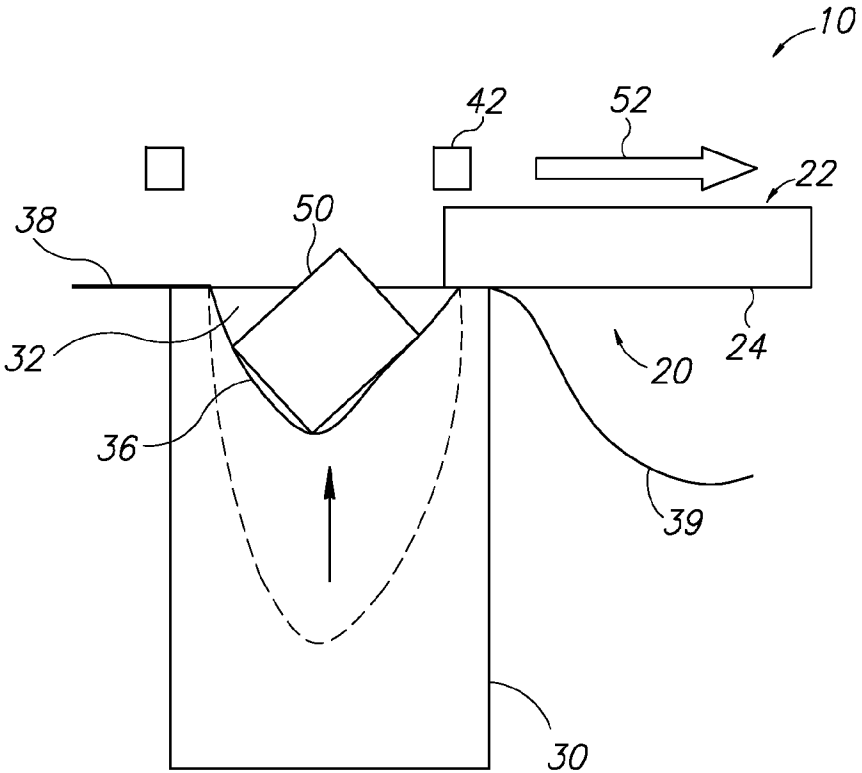
FIGS. 2A and 2B are schematic representations of the system of FIG. 1, seen at different stages of operation, exemplifying use of a semi-confined blast containment container.
Figure 2A:
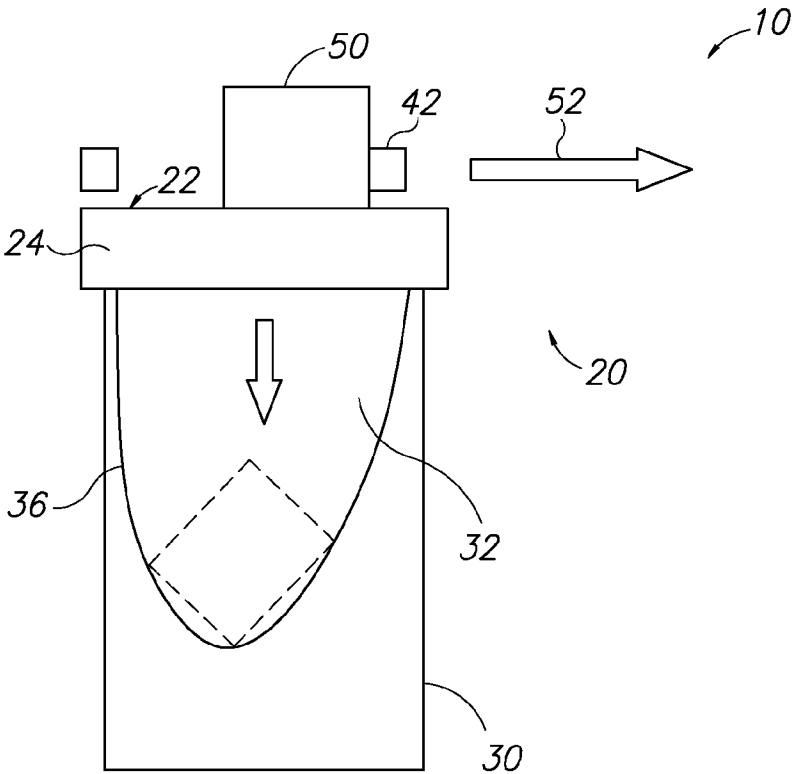

Referring now also to FIGS. 2A and 2B, there is seen a suspicious package 50, which has been placed for inspection on an inspection surface 22, defined by inspection member 24 of inspection module 20. The useful portion of inspection surface 22 is defined by a resistive, barrier member 42 which, as will be appreciated from the description below, forms part of the transfer means 40. The barrier member 42 is mounted in fixed registration over the blast containment container 30, such that relative movement between these two portions of the system cannot occur. The inspection member 24, however, is mounted relative to the blast containment container 30 so as to facilitate movement of inspection member 24, as indicated by an arrow 52 in FIG. 2A, relative to blast containment container 30 and barrier member 42.

As inspection member 24 is moved sideways, as indicated by arrow 52, a similar movement of the suspicious object 50 which is situated thereon and which is sought to be isolated in blast containment container 30, may be caused initially. As seen, the object 50 is initially above an inlet 32 of the blast containment container 30, but is supported thereover by inspection member 24. As the inspection member 24 is moved to the side, to the position illustrated in FIG. 2B inlet 32 is uncovered, thus causing object 50, which is prevented from further lateral movement by barrier member 42, to fall under gravity into inlet 32 and into the blast containment container 30. Movement of the inspection member 24 can be provided by any suitable sliding, swinging or pivoting mechanisms, largely as exemplified by the systems shown and described hereinbelow in conjunction with any of the embodiments of FIGS. 3A-8B.

In the illustrated example, in which container 30 is a semi-confined blast containment container, there is also provided retrieval means 48, as described generally above, in conjunction with FIG. 1. The retrieval means 48 includes a liner 36, to which is attached a handle 38, typically formed as a cable or wire, and also includes a retrieval member 39, exemplified herewith also as a cable or wire.

The liner 36 is typically formed of any suitable, soft material, and is operative to limit damage to a suspicious object. This is necessary in order to cushion and thus prevent unnecessary, premature detonation of an explosive device as it falls into container 30, and also serves to protect damage to fragile objects if isolated in container 30. On the assumption that object 50 does not detonate, it will of course be necessary to remove it from container 50 for further inspection by authorized personnel, and in a safe environment, as decided by such personnel in consideration of the circumstances.

Accordingly, handle 38 is provided so as to pull liner 36, as illustrated in FIG. 2B, thereby raising it from the position indicated in broken lines to the full-line position, thereby causing object 50 to be elevated for further treatment. Clearly, handle 38, which as described, is a cable or the like, is typically of sufficient length, so that this operation can be performed remotely from the remainder of system 10. It will also be appreciated that handle 38 can alternatively be any means, such as a remotely operated pulley, or any other suitable means for fulfilling the described function.

Additionally, as described, retrieval means 48 also includes a retrieval member 39, for moving the system 10 to a safe location. Retrieval member 39 too, can be any means, such as a remotely operated pulley, or any other suitable means for fulfilling the described function.

In accordance with the present invention, any suitable blast containment container may be employed. By way of example only, container 30 could be a semi-confined or fully confined bomb containment waste container manufactured and sold by the Mistral Security Inc., of Bethesda, Md., USA. Alternatively, it could be provided by a Blastsafe™ containment system for explosives, which is a total confinement container, also manufactured by Mistral Security Inc. It will further be appreciated that either of these types of container, or any other suitable type, may be employed as part of the safe inspection system shown and described herein.

Various embodiments of the invention are now described with reference to FIGS. 3A-4. For the purpose of conciseness, components that have already been described above in conjunction with FIGS. 1-2B are not specifically described again hereinbelow, and such components are denoted with reference numerals similar to those employed hereinabove, but with the addition of a prefix corresponding to the number of the principal drawings in which they appear. Thus, for example, in FIGS. 3A-4, the blast containment container referenced 30 in FIGS. 1-2B, is denoted by the reference numeral 330, while in FIGS. 5A-6B the same component is denoted by the reference numeral 530.

It will further be appreciated that while examples of specific combinations only, are shown and described hereinbelow, in accordance with the present invention, different types of components may be employed with different embodiments of the invention, even if not specifically described. Thus, by way of example only, the embodiments shown and described below in conjunction with FIGS. 3A-6B could incorporate the fully confined container employed in the embodiment of FIGS. 7A-8B, and vice versa.

Figure 3B:
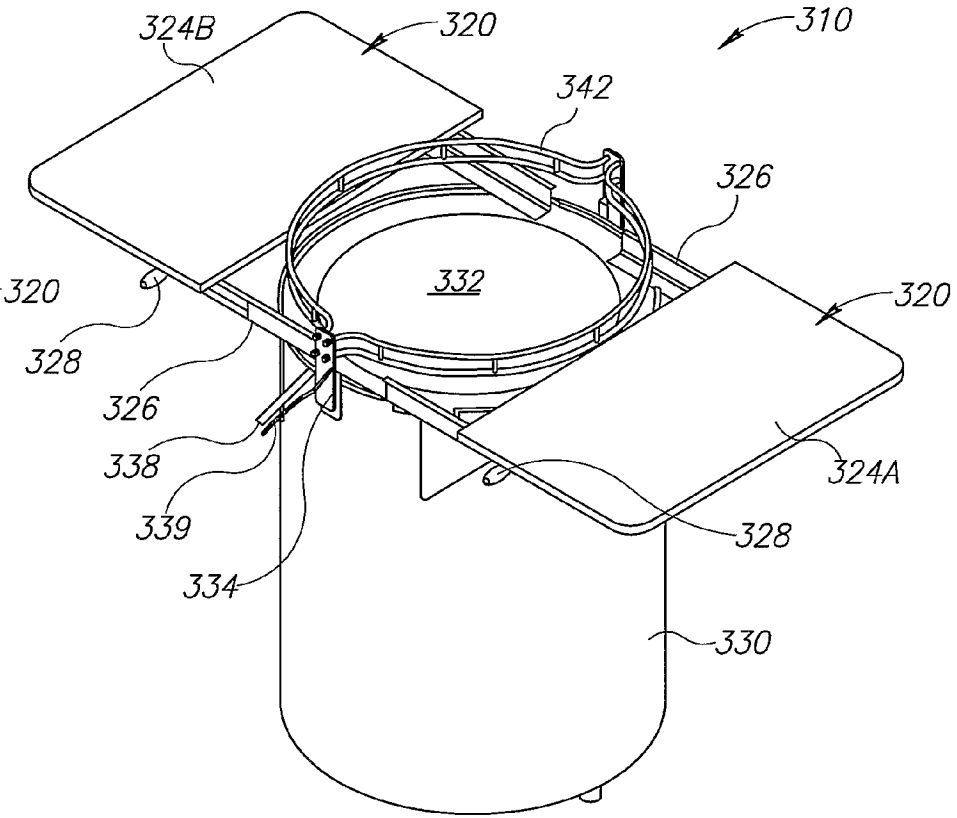
FIGS. 3A and 3B are pictorial views of a first embodiment of the system of the present invention, in which the inspection module is formed of a pair of mutually and oppositely slidable planar inspection elements, mounted above a semi-confined blast containment container, wherein the inspection module is illustrated in respective closed and open positions.
Figure 3A:
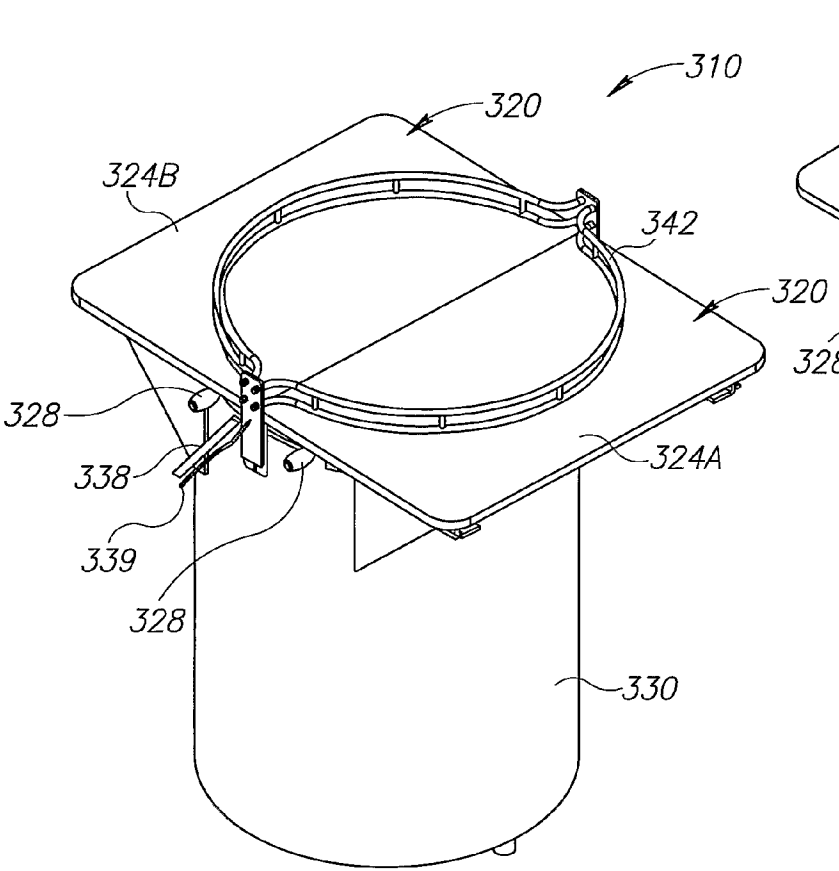
Figure 4:
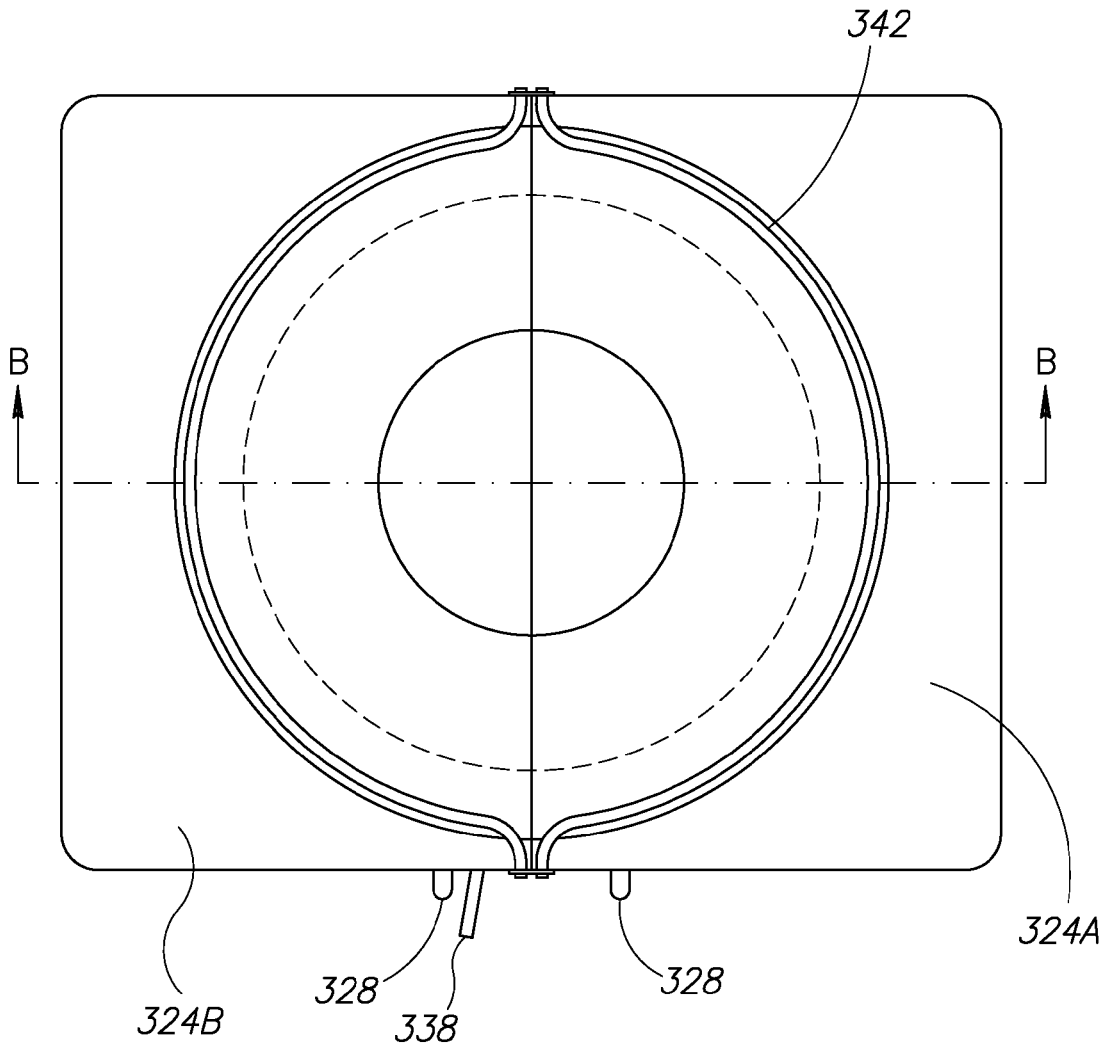
FIG. 4 is a more detailed plan view of the safe inspection system in a closed position, as depicted in FIG. 3A.

Referring now to FIGS. 3A-4, there is provided a safe inspection system, referenced generally 310, constructed and operative in accordance with a first embodiment of the present invention.

System 310 is characterized by employing a pair of mutually and oppositely slidable planar inspection elements, referenced 324*a* and 324*b*, mounted for sliding motion between inlet 332 (FIG. 3B) of blast containment container 330, and barrier element 342, which is affixed to an upper portion of container 330 as by any suitable connection means, 334 (FIG. 3B). As seen in FIG. 3B, the sliding motion is facilitated by any suitable track means, referenced 326, which enable a lateral opening of inspection elements 320, as required. Typically, there are provided a pair of handles 328 for manually sliding apart the inspection elements, although this is by way of example only, and any other hand or foot operated means, whether manual, automatic or semi-automatic, are considered to be well within the scope of the present invention.

Referring now to FIGS. 5A-6C, there is provided a safe inspection system, referenced generally 510, constructed and operative in accordance with a second embodiment of the present invention.

Figure 5A:
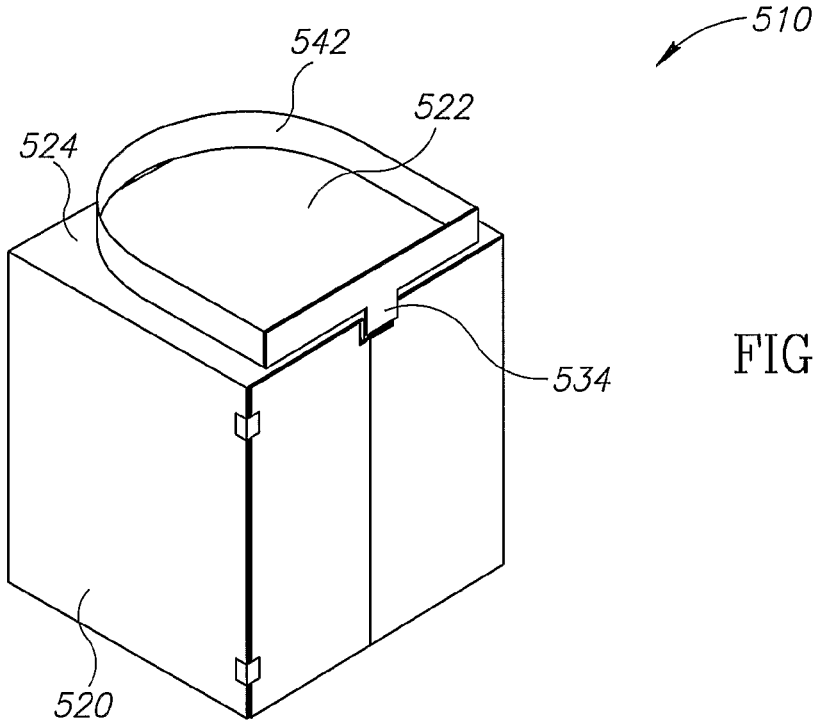
FIGS. 5A and 5B are pictorial views of a second embodiment of the system of the present invention, in which the inspection module is an upward-facing portion of a housing containing a semi-confined blast containment container, wherein the system is illustrated in respective closed and open positions.
Figure 5B:
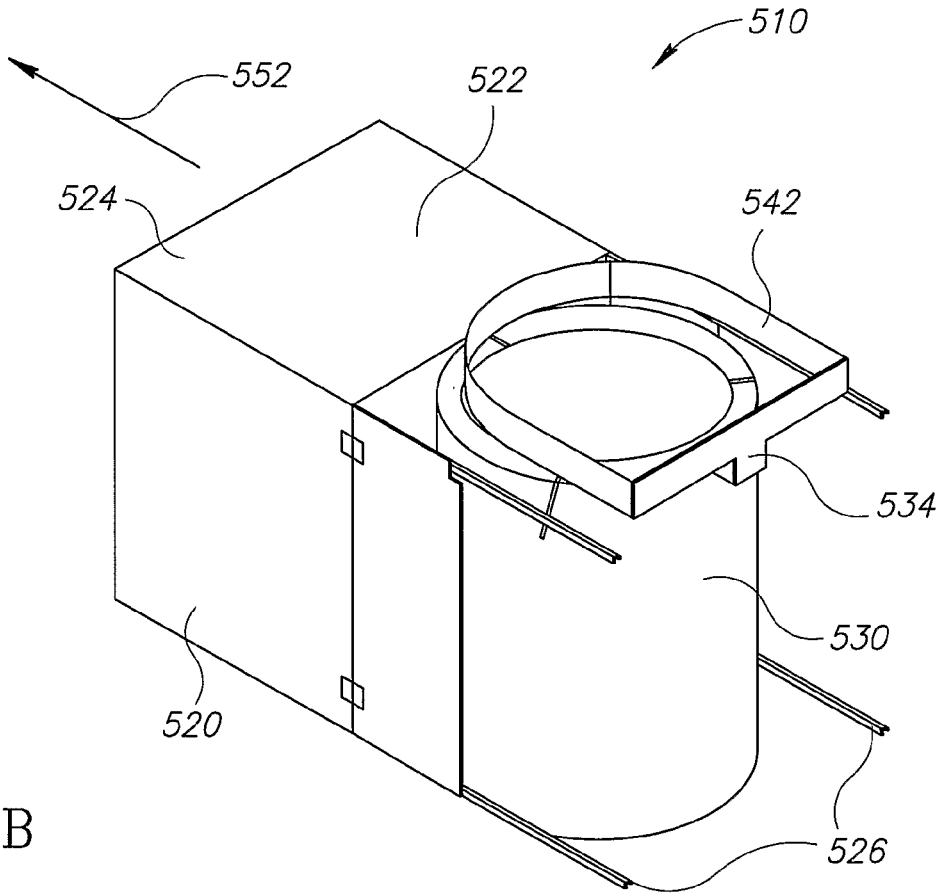
Figure 5C:
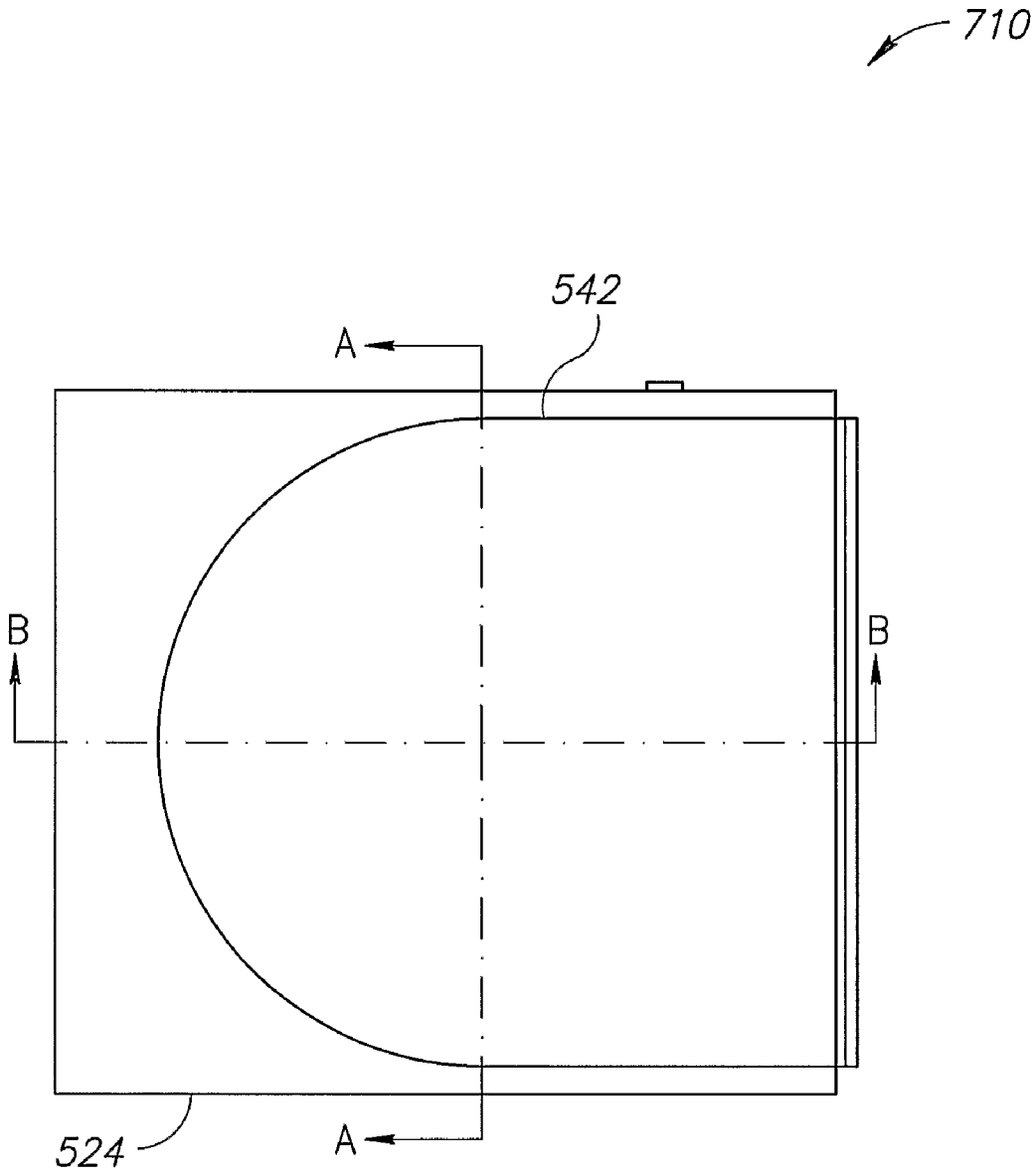
FIG. 5C is a more detailed plan view of the safe inspection system of FIGS. 5A-5B in a closed position, as depicted in FIG. 5A.

System 510 is characterized by employing an inspection module 520 in the form of a housing, such as a suitable formed cabinet, which serves to enclose blast containment container 530 (FIG. 5B). When in a closed position, as illustrated in FIG. 5A, the inspection module defines at an upper portion thereof, an inspection element 524, having thereon inspection surface 522, above which is an arch-shaped barrier element 542, which is affixed to an upper portion of container 530 as by a suitable flanged connection, referenced 534.

As seen in FIG. 5B, housing 520 has inward-facing tracks or slide elements 526, thereby to permit a low-friction, guided lateral motion of the housing 520 and thus inspection surface 522, as indicated schematically by arrow 552, relative to container 530 and barrier element 542, in order to instantly deposit a suspicious object in container 530.

Figure 6A:
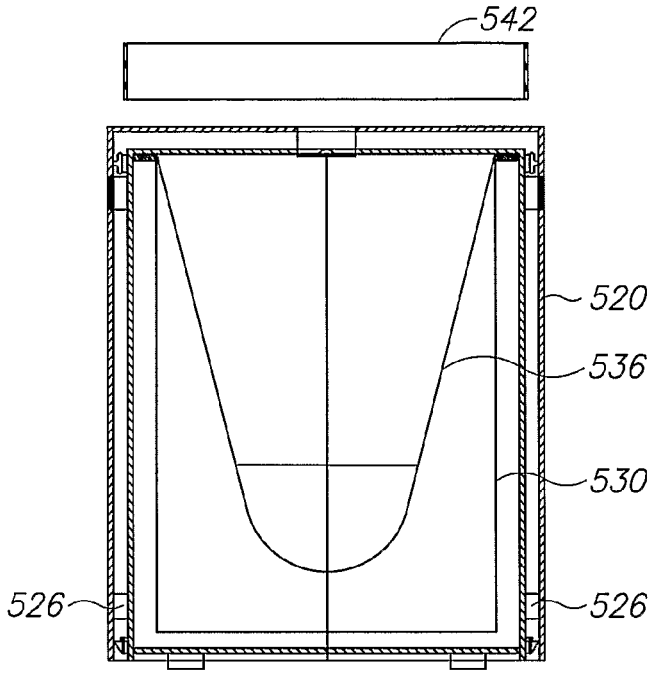
FIGS. 6A and 6B are vertical cross-sectional views of the safe inspection system of FIGS. 5A-5C, as viewed along lines A-A and B-B, respectively, in FIG. 5C.
Figure 6B:
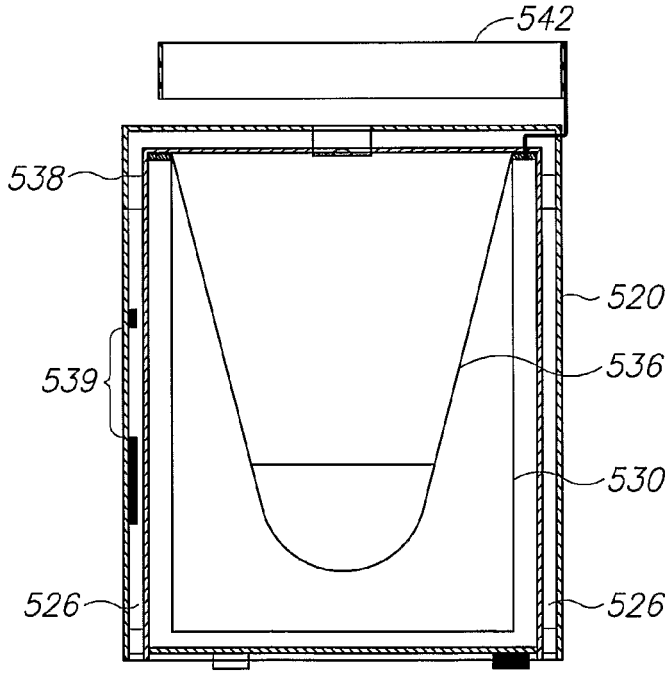

Referring now specifically to FIGS. 6A-6B, it is seen that the exemplary blast containment container 530 of the present embodiment is a semi-confined container, generally as described above, and is thus not described again herein.

Referring now to FIGS. 7A-8B, there is provided a safe inspection system, referenced generally 710, constructed and operative in accordance with a third embodiment of the present invention.

Figure 7B:
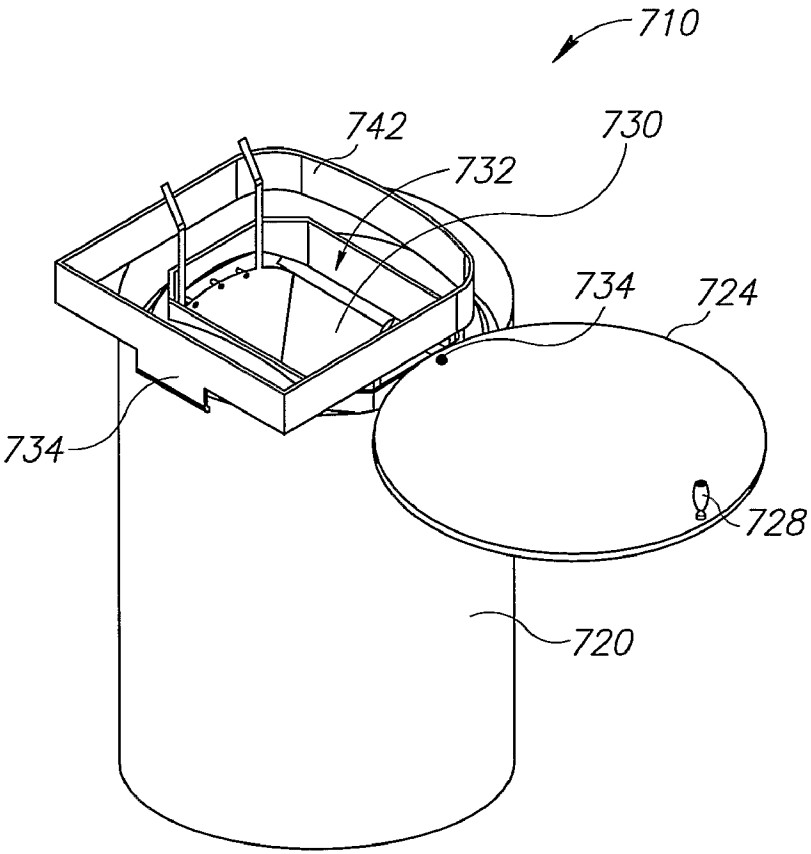
FIGS. 7A and 7B are pictorial views of a third embodiment of the system of the present invention, in which the inspection module is a pivotable planar member mounted over a fully confined blast containment container, wherein the system is illustrated in respective closed and open positions.
Figure 7A:
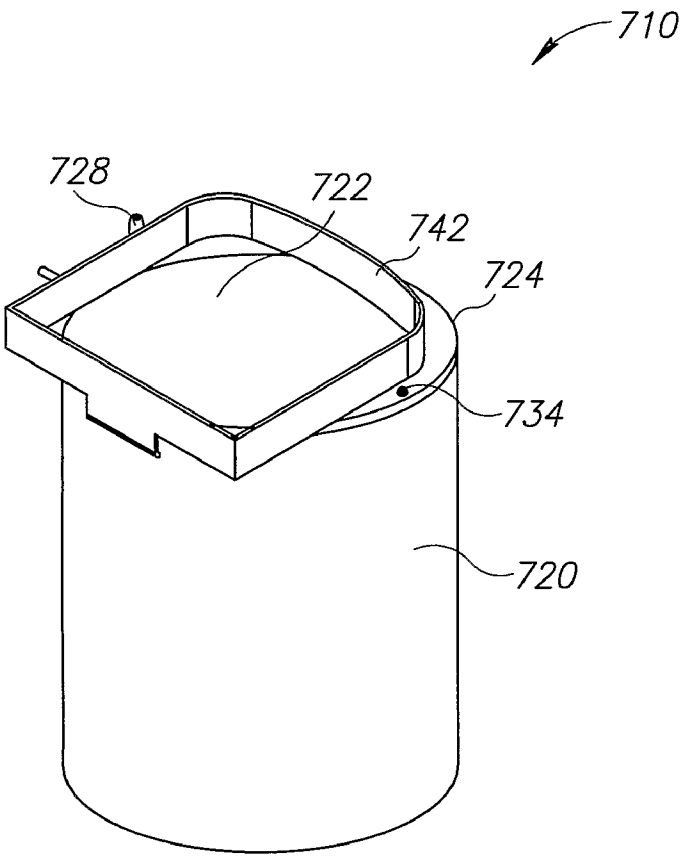
Figure 7C:
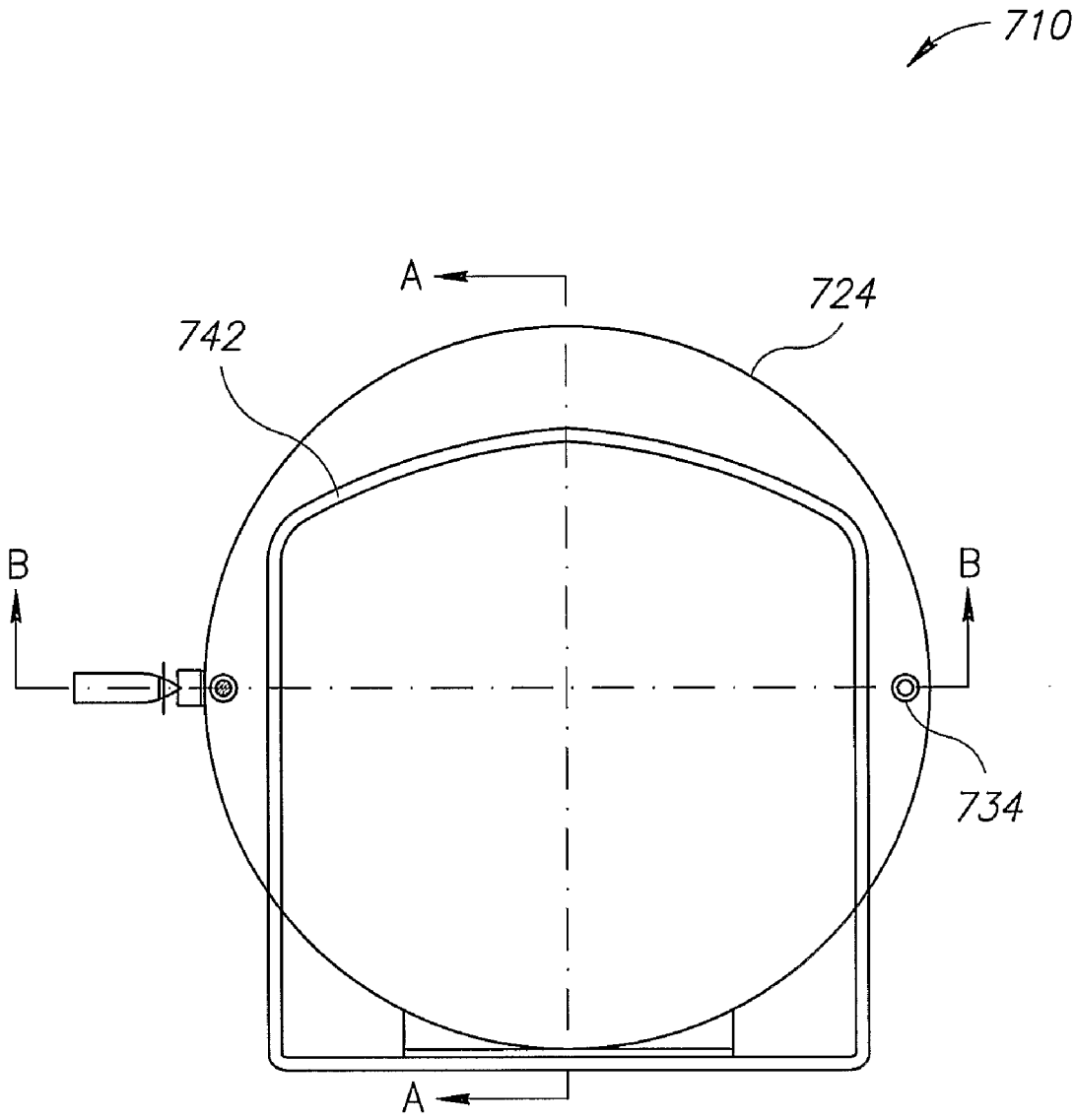
FIG. 7C is a more detailed plan view of the safe inspection system in a closed position, as depicted in FIG. 7A.

FIGS. 7A and 7B are pictorial views of a third embodiment of the system of the present invention, in which the inspection module is a pivotable planar member mounted over a fully confined blast containment container, wherein the system is illustrated in respective closed and open positions.

System 710 is characterized by employing an inspection module 720 in the form of a generally cylindrical housing which serves to enclose blast containment container 730 (FIG. 7B). When in a closed position, as illustrated in FIG. 7A, the inspection module defines at an upper portion thereof, an inspection element 724, having thereon inspection surface 722, above which is an arch-shaped barrier element 742, which is affixed to an upper portion of housing 720 as by a suitable pivot connection, referenced 734. Pivot connection 734 may be provided by a suitable bolt, or the like. As seen in FIG. 7B, in order to easily and rapidly transfer a suspicious object into container 730, it is simply required to grasp inspection member 724, as by handle 728, thereby removing the support provided by inspection surface 722 to the suspicious object, while exposing the inlet 732 of the container 730, instantly causing the object to fall into the container.

Figure 8B:
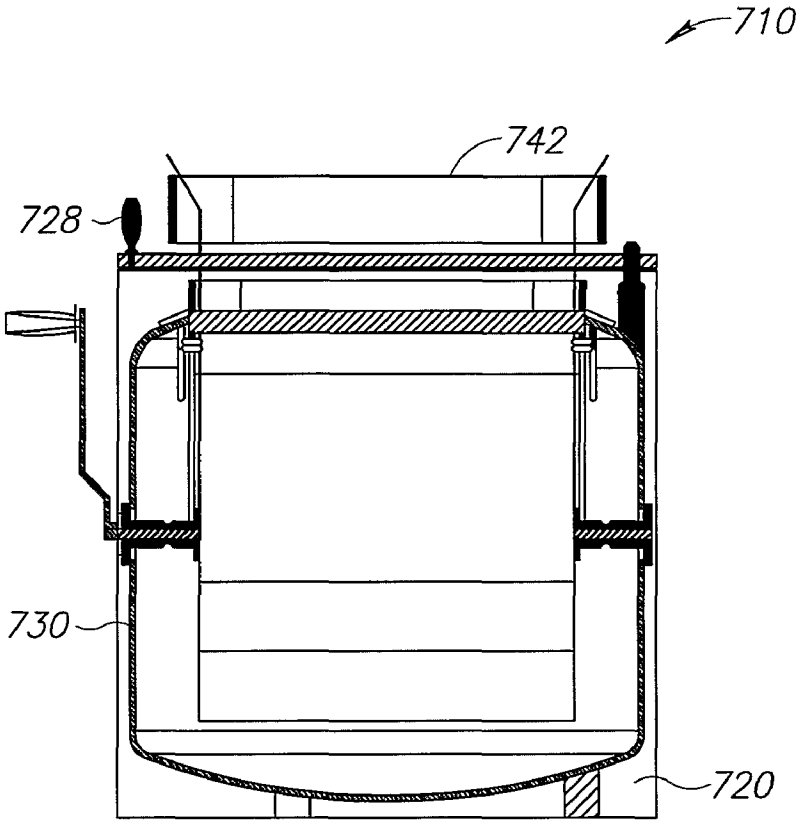
FIGS. 8A and 8B are vertical cross-sectional views of the safe inspection system of FIGS. 7A-7C, as viewed along lines A-A and B-B, respectively, in FIG. 7C.
Figure 8A:
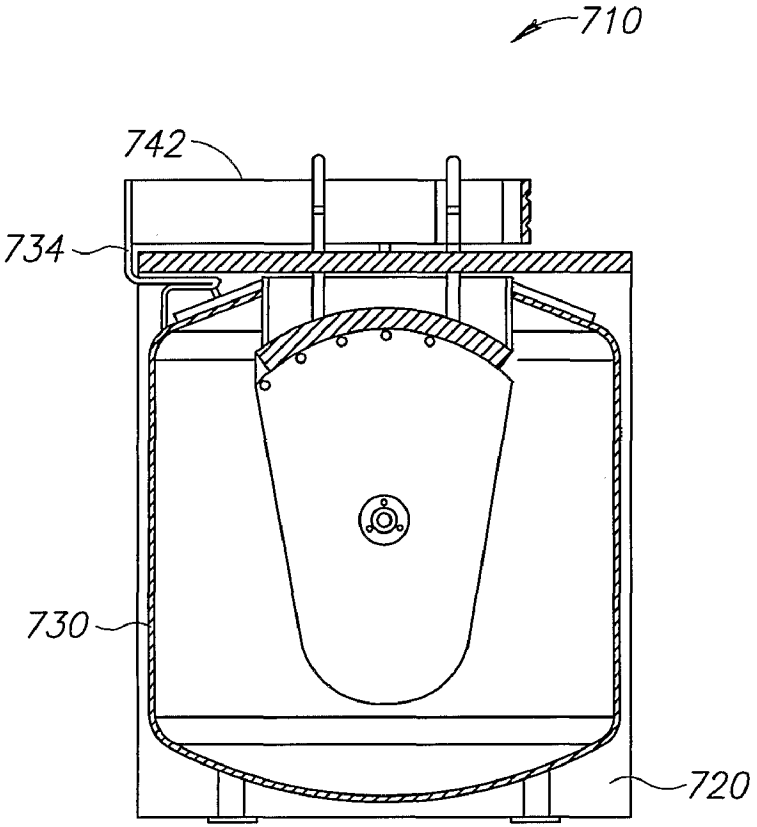

Referring now specifically to FIGS. 8A-8B, it is seen that the exemplary blast containment container 730 of the present embodiment is a total confinement container, generally as described above, and is thus not described again herein.

It will further be appreciated that with the preponderance of containment systems for explosives, as exists in the prior art, the present invention also includes a kit for converting a blast containment container to a safe inspection system, as shown and described hereinabove.

It will be appreciated by persons skilled in the art that the scope of the present invention is not limited to what has been specifically shown and described hereinabove, merely by way of example. Rather, the scope of the present invention is limited solely by the claims, which follow:

What is claimed is:

1. A safe inspection system for the manual inspection of personal luggage, which comprises:

an inspection module including at least one inspection member which defines an inspection surface, for supporting a potentially explosive object for manual inspection by an inspector;

a blast containment container arranged in a position of immediate communication with said inspection module;

transfer apparatus including:

apparatus for movably mounting said inspection module relative to said blast containment container so that when said apparatus for movably mounting is actuated a suspicious object is instantly caused to fall into said container; and a barrier element above said inspection surface, said transfer apparatus effecting the immediate transfer of the inspected object from said inspection surface to said blast containment container by the inspector without requiring further handling of the object by the inspector, thereby to immediately confine the object within said blast containment container so as to thus reduce blast damage in the event that the suspicious object explodes after confinement therewithin; and retrieval apparatus associated with said blast containment container, wherein said retrieval apparatus includes:

a liner located within said containment container for cushioning the fall of the suspicious object into said container; and raising apparatus configured and operative to elevate said liner so as to raise the suspicious object therewithin for further processing.

2. A system according to claim 1, wherein said blast containment container has an inlet for admitting the suspicious object, and wherein said transfer apparatus for effecting the immediate transfer of a suspicious inspected object is operative to selectably move said at least one inspection member relative to said blast containment container from a closed position wherein said at least one inspection member covers said inlet to an open position wherein said at least one inspection member does not cover said inlet.

3. A system according to claim 2, wherein said at least one movable inspection member and surface and said barrier element are disposed generally above said inlet, said barrier element applying a resistive force to the suspicious object so as to maintain it generally over said inlet until said inlet is exposed by said movement of said inspection member, such that said inspection surface no longer supports the suspicious object thereon, thereby to cause the admission of the suspicious object through said inlet of said blast containment container under gravitational acceleration.

4. A system according to claim 3, wherein said at least one movable inspection member has a generally horizontal orientation, and said transfer apparatus for effecting the immediate transfer of the inspected object from said inspection surface to said blast containment container moves said at least one movable inspection member in a generally lateral direction, thereby to uncover said inlet of said blast containment container, and said barrier element is arranged over a portion of said inspection surface, operative to cause a relative movement between the object located on said inspection surface and said inspection surface, thereby to maintain the object generally over said inlet until exposure thereof.

5. A system according to claim 4, wherein said barrier element is arranged in a stationary position with respect to said inlet of said blast containment container.

6. A system according to claim 1, wherein said apparatus for movably mounting said inspection module relative to said blast containment container, includes one of the group which consists of:

pivot apparatus;

sliding apparatus; and track apparatus.

7. A system according to claim 1, wherein said retrieval apparatus further includes a retrieval member, said member configured and operative to move said system from a first location to a second location, for further processing of the suspicious object within said container.

8. A system according to claim 1, wherein said blast containment container is one of the group which consists of:

a semi-confined blast containment container; and a fully confined blast containment container.

9. A safe inspection system for the manual inspection of personal luggage, which comprises:

an inspection module including at least one inspection member which defines an inspection surface, for supporting a potentially explosive object for manual inspection by an inspector;

a blast containment container arranged in a position of immediate communication with said inspection module, said container having an inlet for admitting the object, said at least one movable inspection member and surface disposed generally above said inlet;

transfer apparatus for effecting the immediate transfer of the inspected object from said inspection surface to said blast containment container by the inspector without requiring further handling of the object by the inspector, said transfer apparatus including:

apparatus for movably mounting said inspection module relative to said blast containment container so that when said apparatus for movably mounting is actuated a suspicious object is instantly caused to fall into said container, and a barrier element which is configured to circumscribe said inlet of said container and operative to apply a resistive force to the object so as to maintain the object generally over said inlet until said inlet is exposed by movement of said inspection member by said transfer apparatus for effecting the immediate transfer of the inspected object, such that said inspection surface no longer supports the object thereon, thereby to cause the admission of the object through said inlet of said blast containment container under gravitational acceleration and to immediately confine the object within said blast containment container so as to thus reduce blast damage in the event that the object explodes after confinement therewithin.

10. A system according to claim 9, wherein said transfer apparatus for effecting the immediate transfer of a suspicious inspected object is operative to selectably move said at least one inspection member relative to said blast containment container from a closed position wherein said at least one inspection member covers said inlet to an open position wherein said at least one inspection member does not cover said inlet.

11. A system according to claim 10, wherein said at least one movable inspection member has a generally horizontal orientation, and said transfer apparatus for effecting the immediate transfer of the inspected object from said inspection surface to said blast containment container by moving said at least one movable inspection member in a generally lateral direction, thereby to uncover said inlet of said blast containment container, and said barrier element is arranged over a portion of said inspection surface, operative to cause a relative movement between the object located on said inspection surface and said inspection surface, thereby to maintain the object generally over said inlet until exposure thereof.

12. A system according to claim 11, wherein said barrier element is arranged in a stationary position with respect to said inlet of said blast containment container.

13. A system according to claim 9, wherein said apparatus for movably mounting includes one of the group which consists of:

pivot apparatus;

sliding apparatus; and track apparatus.

14. A system according to claim 9, also including retrieval apparatus associated with said blast containment container, wherein said retrieval apparatus includes:

a liner located within said containment container for cushioning the fall of the suspicious object into said container; and raising apparatus configured and operative to elevate said liner so as to raise the suspicious object therewithin for further processing.

15. A system according to claim 9, also including retrieval apparatus associated with said blast containment container, wherein said retrieval apparatus includes a retrieval member, said member configured and operative to move said system from a first location to a second location, for further processing of the suspicious object within said container.

16. A system according to claim 9, wherein said blast containment container is one of the group which consists of:

a semi-confined blast containment container; and a fully confined blast containment container.

17. A safe inspection system for the manual inspection of personal luggage, which comprises:

an inspection module including at least one inspection member which defines an inspection surface, for supporting a potentially explosive object for manual inspection by an inspector;

a blast containment container arranged in a position of immediate communication with said inspection module, said container having an inlet for admitting the object, said at least one movable inspection member and surface disposed generally above said inlet;

transfer apparatus for effecting the immediate transfer of the inspected object from said inspection surface to said blast containment container by the inspector without requiring further handling of the object by the inspector, said transfer apparatus including a barrier element which is configured to circumscribe said inlet of said container and operative to apply a resistive force to the object so as to maintain the object generally over said inlet until said inlet is exposed by movement of said inspection member by said transfer apparatus for effecting the immediate transfer of the inspected object, such that said inspection surface no longer supports the object thereon, thereby to cause the admission of the object through said inlet of said blast containment container under gravitational acceleration and to immediately confine the object within said blast containment container so as to thus reduce blast damage in the event that the object explodes after confinement therewithin.

18. A system according to claim 17, wherein said transfer apparatus for effecting the immediate transfer of a suspicious inspected object is operative to selectably move said at least one inspection member relative to said blast containment container from a closed position wherein said at least one inspection member covers said inlet to an open position wherein said at least one inspection member does not cover said inlet.

19. A system according to claim 18, wherein said at least one movable inspection member has a generally horizontal orientation, and said transfer apparatus for effecting the immediate transfer of the inspected object from said inspection surface to said blast containment container by moving said at least one movable inspection member in a generally lateral direction, thereby to uncover said inlet of said blast containment container, and said barrier element is arranged over a portion of said inspection surface, operative to cause a relative movement between the object located on said inspection surface and said inspection surface, thereby to maintain the object generally over said inlet until exposure thereof.

20. A system according to claim 19, wherein said barrier element is arranged in a stationary position with respect to said inlet of said blast containment container.

21. A system according to claim 17, and including apparatus for movably mounting said inspection module relative to said blast containment container, said apparatus for movably mounting includes one of the group which consists of:

pivot apparatus;

sliding apparatus; and track apparatus.

22. A system according to claim 17, also including retrieval apparatus associated with said blast containment container, wherein said retrieval apparatus includes:

a liner located within said containment container for cushioning the fall of the suspicious object into said container; and raising apparatus configured and operative to elevate said liner so as to raise the suspicious object therewithin for further processing.

23. A system according to claim 17, also including retrieval apparatus associated with said blast containment container, wherein said retrieval apparatus includes a retrieval member, said member configured and operative to move said system from a first location to a second location, for further processing of the suspicious object within said container.

24. A system according to claim 17, wherein said blast containment container is one of the group which consists of:

a semi-confined blast containment container; and a fully confined blast containment container.

* * * * *